US008776708B2

(12) United States Patent
Cordier

(10) Patent No.: US 8,776,708 B2
(45) Date of Patent: Jul. 15, 2014

(54) MECHANISED DEVICE FOR RIGGING A SAIL

(76) Inventor: Stephane Cordier, Pornic (FR)

( * ) Notice: Subject to any disclaimer, the term of this patent is extended or adjusted under 35 U.S.C. 154(b) by 178 days.

(21) Appl. No.: 13/202,915

(22) PCT Filed: Feb. 19, 2010

(86) PCT No.: PCT/EP2010/052137

§ 371 (c)(1),
(2), (4) Date: Aug. 23, 2011

(87) PCT Pub. No.: WO2010/094770

PCT Pub. Date: Aug. 26, 2010

(65) Prior Publication Data

US 2011/0303140 A1 Dec. 15, 2011

(30) Foreign Application Priority Data

Feb. 23, 2009 (FR) ..... 09 51131

(51) Int. Cl.
*B63H 9/04* (2006.01)

(52) U.S. Cl.
USPC ..... 114/102.12; 114/108

(58) Field of Classification Search
CPC ..... B63H 9/00; B63H 9/08; B63H 9/106
USPC ..... 114/104, 105, 102.12, 109, 112–114
See application file for complete search history.

(56) References Cited

U.S. PATENT DOCUMENTS

| | | | | |
|---|---|---|---|---|
| 4,388,888 | A * | 6/1983 | Gushurst, Jr. | 114/90 |
| 4,685,410 | A * | 8/1987 | Fuller | 114/39.31 |
| 4,823,720 | A * | 4/1989 | Foster | 114/98 |
| 5,787,830 | A * | 8/1998 | Frederiksen | 114/104 |

FOREIGN PATENT DOCUMENTS

| | | |
|---|---|---|
| DE | 26 08 471 | 9/1977 |
| DE | 30 35 028 A1 | 4/1982 |
| DE | 37 18414 A1 | 12/1988 |
| WO | WO 99/37537 | 7/1999 |
| WO | WO 02/44021 A1 | 6/2002 |

* cited by examiner

*Primary Examiner* — Stephen Avila
*Assistant Examiner* — Andrew Polay
(74) *Attorney, Agent, or Firm* — Pauley Petersen & Erickson

(57) ABSTRACT

There is provided a mechanized device for rigging a sail of a ship that includes: a mast, a boom and a gaff secured to the mast by the respective front ends thereof, a guiding element linking the two rear ends of the boom and the gaff, and delimiting a frame together with the mast, a rectangular sail, secured to the boom by the edge thereof, and equipped on the hoist and leech thereof with a means for guiding respectively along the mast and along the guiding element, a mechanized means for hoisting and lowering the sail in the frame, while keeping the hoist and the leech thereof respectively guided along the mast and along the guiding element.

13 Claims, 7 Drawing Sheets

MECHANISED DEVICE FOR RIGGING A SAIL

Figure 1:
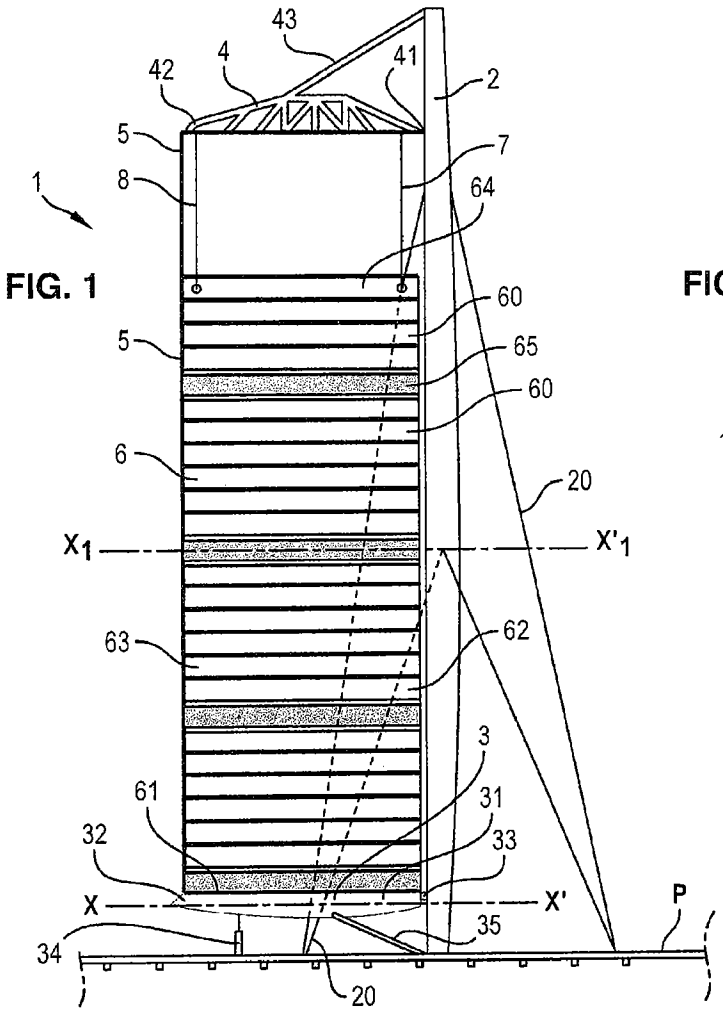

The present invention concerns a mechanised device, which may or may not be automated, for rigging a sail of a ship.

More precisely, it concerns a device allowing a sail to be hoisted and lowered, including a sail of very large dimensions possibly as large as 1 000 $m^2$ and in mechanised, reliable manner so that it is possible to use this sail on large yachts but also on cargo vessels or passenger ships as auxiliary propelling system. Said device can even be automated.

For maximum simplification of human effort, numerous mechanised devices for manipulating sails have been developed. They generally use a roller furling device placed in the stay, in the mast, in the boom or in the yards.

However, roller furling technology is limited by its capacity to control the quality of furling of large-size sails having a surface of more than 1 000 $m^2$, all the more so under strong wind conditions.

Other solutions consist of furling the sail horizontally on the boom or on the deck. However, these techniques do not provide control over the sail in the event of gusts of winds, and this may cause damage to the sail or the ship and may even be a source of risk for any crew members present around the sail.

On this account, the use of these devices is limited to winds of moderate force, which considerably reduces the advantage of using sails as auxiliary propelling mode.

From document DE 3718414 a device is also known which comprises several horizontal spars capable of sliding along a mast at their median part. Several sails are attached each between an upper spar and a lower spar. The sails can be deployed by hoisting the upper spar along the mast, this movement of the spar causing traction on the upper part of the sail. Conversely, the sails are lowered by descending the upper spar along the mast.

In lowered position, the sails and the spars are on the deck, and the sails are not correctly folded thereby taking up much space.

Said device cannot be used therefore for sails of very large dimensions.

From DE 26 08 471 a similar device is also known in which a sail is hoisted by moving the upper spar along the mast, the sail then being tautened by lateral traction.

When the sail is lowered, its descent is not guided which means that the sail may flap in the wind.

Said device cannot be used for sails of very large dimensions and may prove to be dangerous for nearby crew.

It is therefore the objective of the invention to solve the aforementioned disadvantages of the state of the art.

It is one particular objective of the invention to provide a manipulating device which allows:

- a sail to be hoisted and lowered in mechanised and optionally fully automated manner, including a sail of very large dimensions and of heavy weight,
- in full safety for the crew and the ship whilst avoiding any damage to the sail,
- the use of this device as frequently as possible including under relatively strong wind conditions,
- guaranteed minimum maintenance on the sail and long-lasting lifetime thereof.

A further objective of the invention is to provide a device with which it is possible to provide full control over the sail during hoisting or lowering operations, without the risk of all or part of the sail taking up a position in which, having regard to its size and weight, fully safe storage thereof would no longer be possible.

For this purpose, the invention concerns a mechanised device for manipulating a ship's sail.

According to the invention, this device comprises:

- a mast,
- a boom and gaff secured to said mast respectively via one of their so-called "fore" ends,
- a guiding element connecting the two opposite so-called "aft" ends of said boom and said gaff, so that this guiding element extends parallel or substantially parallel to the mast and it defines a frame jointly with the mast, the boom and the gaff,
- a sail of rectangular or substantially rectangular shape, secured to the boom via its lower so-called "foot" edge, and provided on its two side edges called "luff" and "leech" with guiding means respectively along the mast and along said guiding element,
- mechanised means of hoisting and lowering said sail inside the said frame, with maintained guiding of the luff and leech of the sail along the mast and along said guiding element respectively.

By means of these characteristics of the invention, the gaff remains in position while the sail is hoisted or lowered, and in addition the luff and the leech of the sail are supported including when the sail is lowered. It can therefore be automatically furled over the boom in an accordion fold.

With this solution, it is possible to store the sail in full safety and to perform rapid, mechanised and safe hoisting and lowering operations of the sail.

According to other advantageous and non-limiting characteristics of the invention, taken alone or in combination,

- the said guiding element is a cable;
- the sail is composed of several panels, each panel is provided along its luff with a guiding member on the mast and along its leech with a guiding member on said guiding element, and these guiding members allowing rotation of said panel around a longitudinal axis $X_2$-$X'_2$ joining together these two guiding members, this axis of rotation $X_2$-$X'_2$ also being parallel or substantially parallel to the boom, so that the sail folds accordion-wise on the boom when it is lowered;
- the mast comprises a longitudinal guide rail, the guiding member of the luff of the sail comprises a traveller sliding along said guide rail, this traveller being provided with a rotating spindle extending over the axis of rotation $X_2$-$X_2$ and being received in an antifriction bearing secured to the luff of the sail;
- the mast comprises a longitudinal guide rail, the guiding member of the luff of the sail comprises a traveller sliding along said guide rail, this traveller being provided with a pin which extends over the axis of rotation $X_2$-$X'_2$ and whose end is provided with a ball joint received in a multidirectional hinge bearing secured to the luff of the sail;
- the guiding member of the leech of the sail is a slide which comprises a sleeve sliding along the guiding element and is provided with a rotating spindle which extends over the axis of rotation $X_2$-$X'_2$, this rotating spindle being received in an anti-friction bearing secured to the leech of the sail;
- the sail comprises several panels, each panel being hinged on the adjacent panel around a so-called "hinge" axis $X_1$-$X'_1$, parallel or substantially parallel to the boom;
- each panel is hinged to the adjacent panel via a portion of flexible material, a hinge or a strap;
- at least one of the panels is provided with a longitudinal batten which extends over the axis of rotation $X_2$-$X'_2$ of said panel;

each panel is removably attached to the others so that it can separated from the others, dismounted and replaced;

the mechanised means of hoisting and lowering the sail comprise means for tensioning the luff and the leech of the sail in synchronized manner, so that at any time during the hoisting and lowering phases of the sail, the fore and aft halyard points of the said sail are at the same height;

the sail is made of fabric, composite material or metal.

The invention also concerns a cargo vessel or passenger ship equipped with the aforementioned mechanised device for manipulating a sail.

Other characteristics and advantages of the invention will become apparent from the description which will now be given with reference to the appended drawings, which by way of indication but in non-limiting manner illustrate various variants of possible embodiments.

Figure 2:
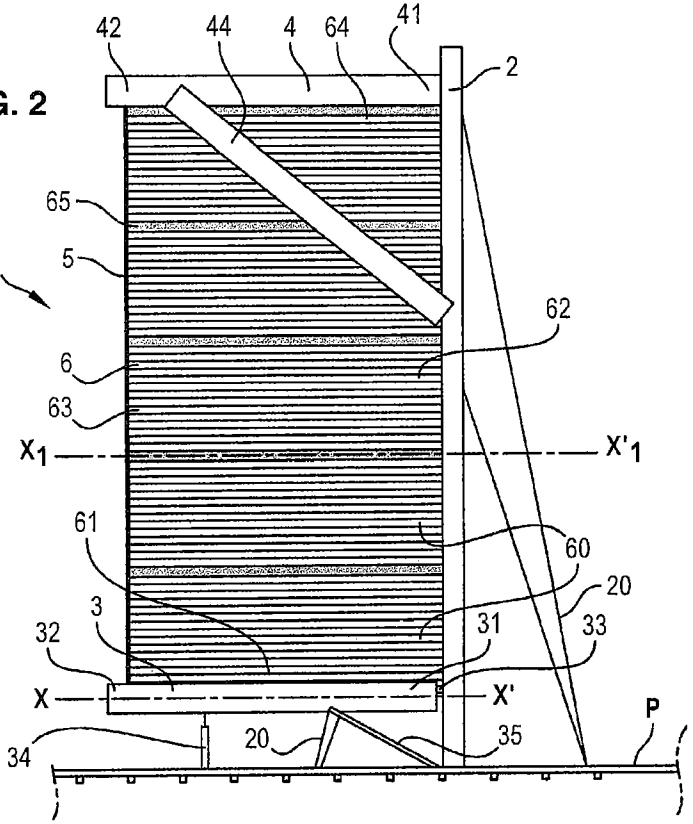
Figure 3:
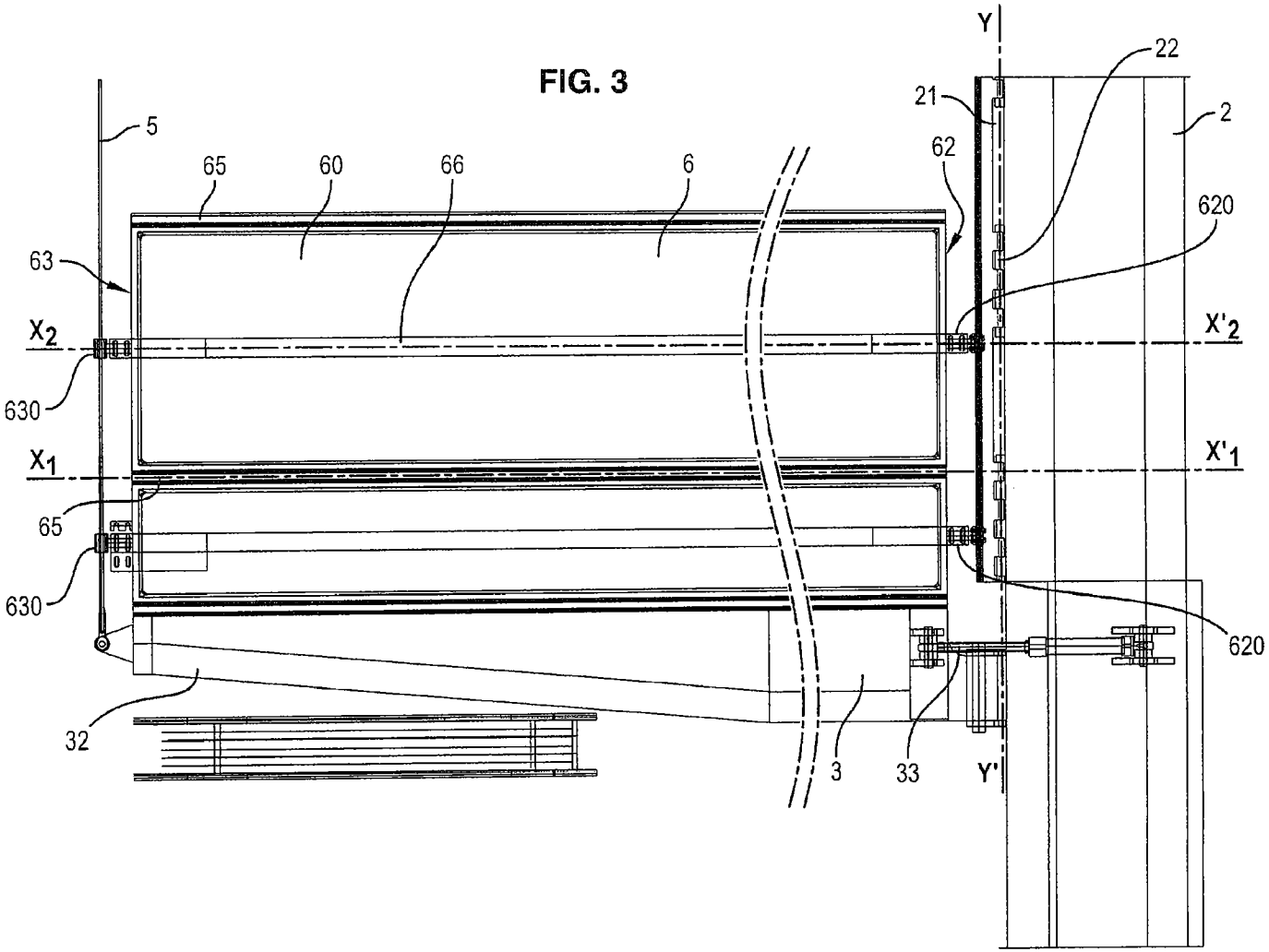
Figure 4:
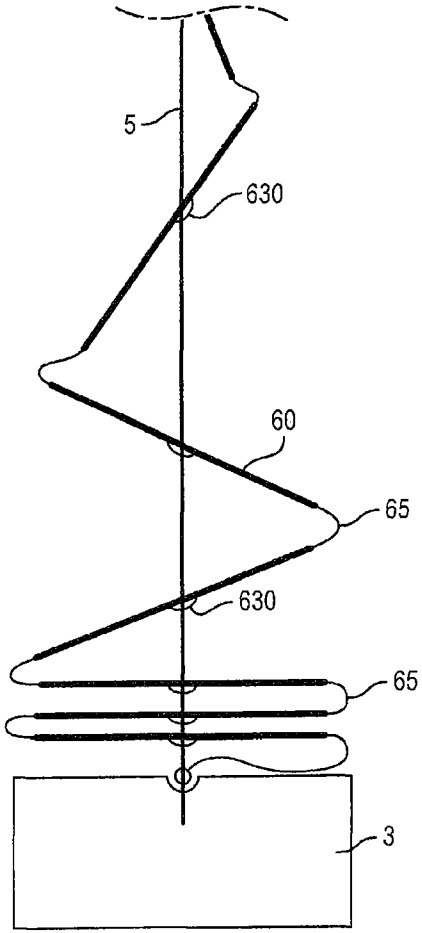
Figure 5:
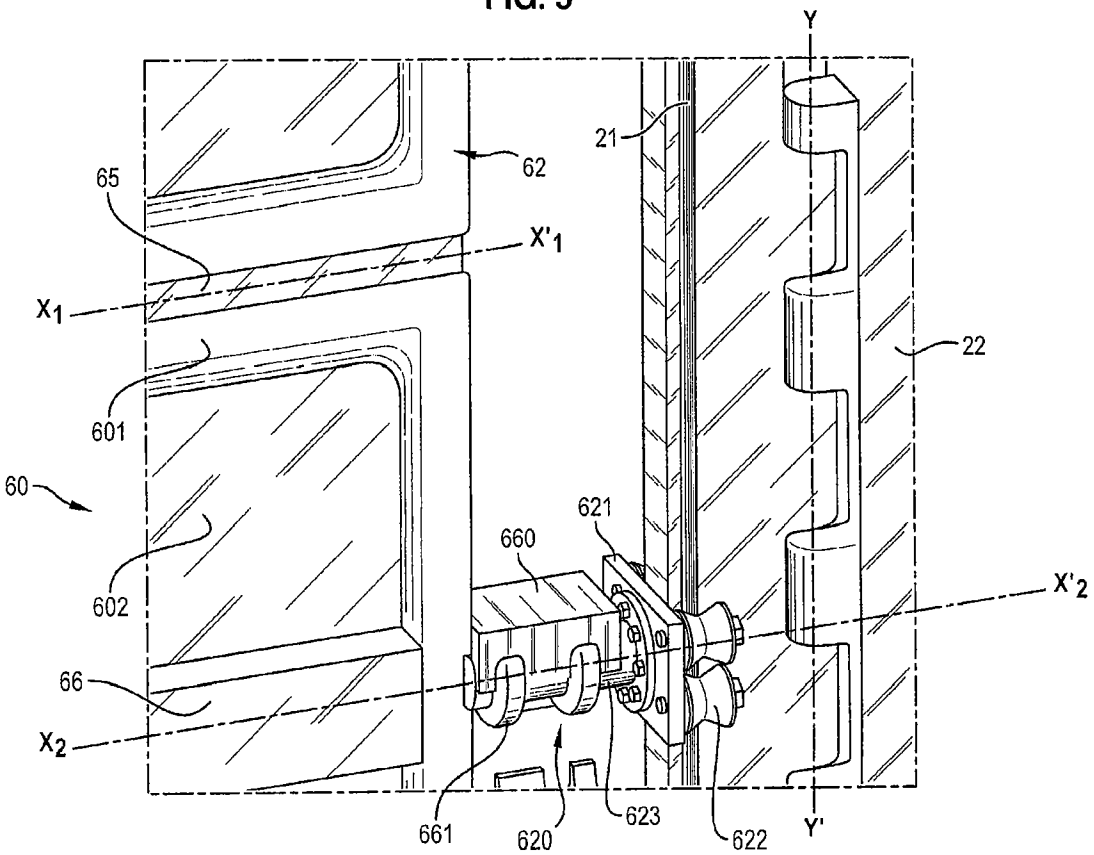
Figure 6:
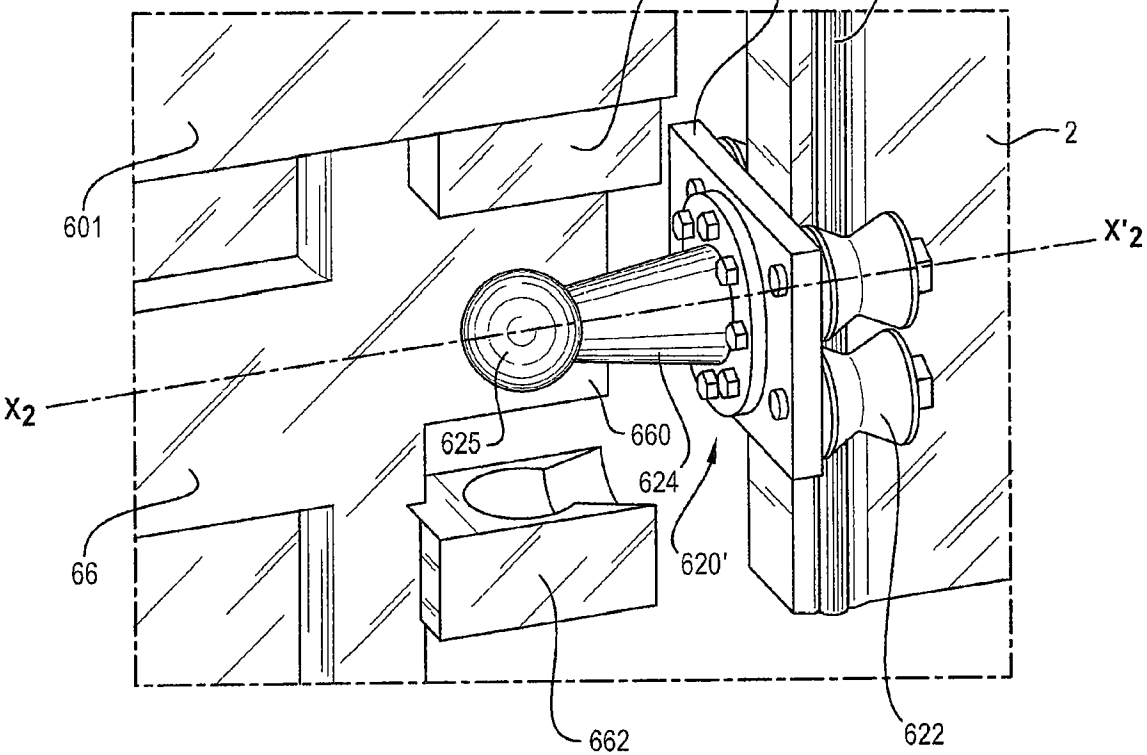
Figure 7:
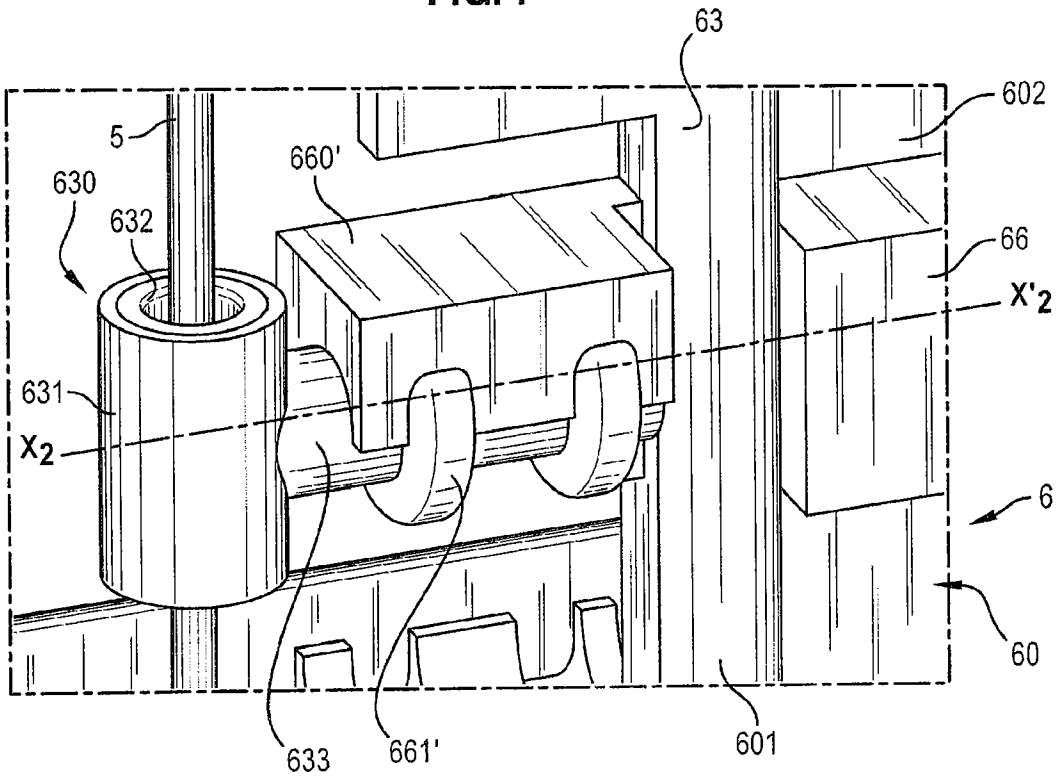
Figure 8:
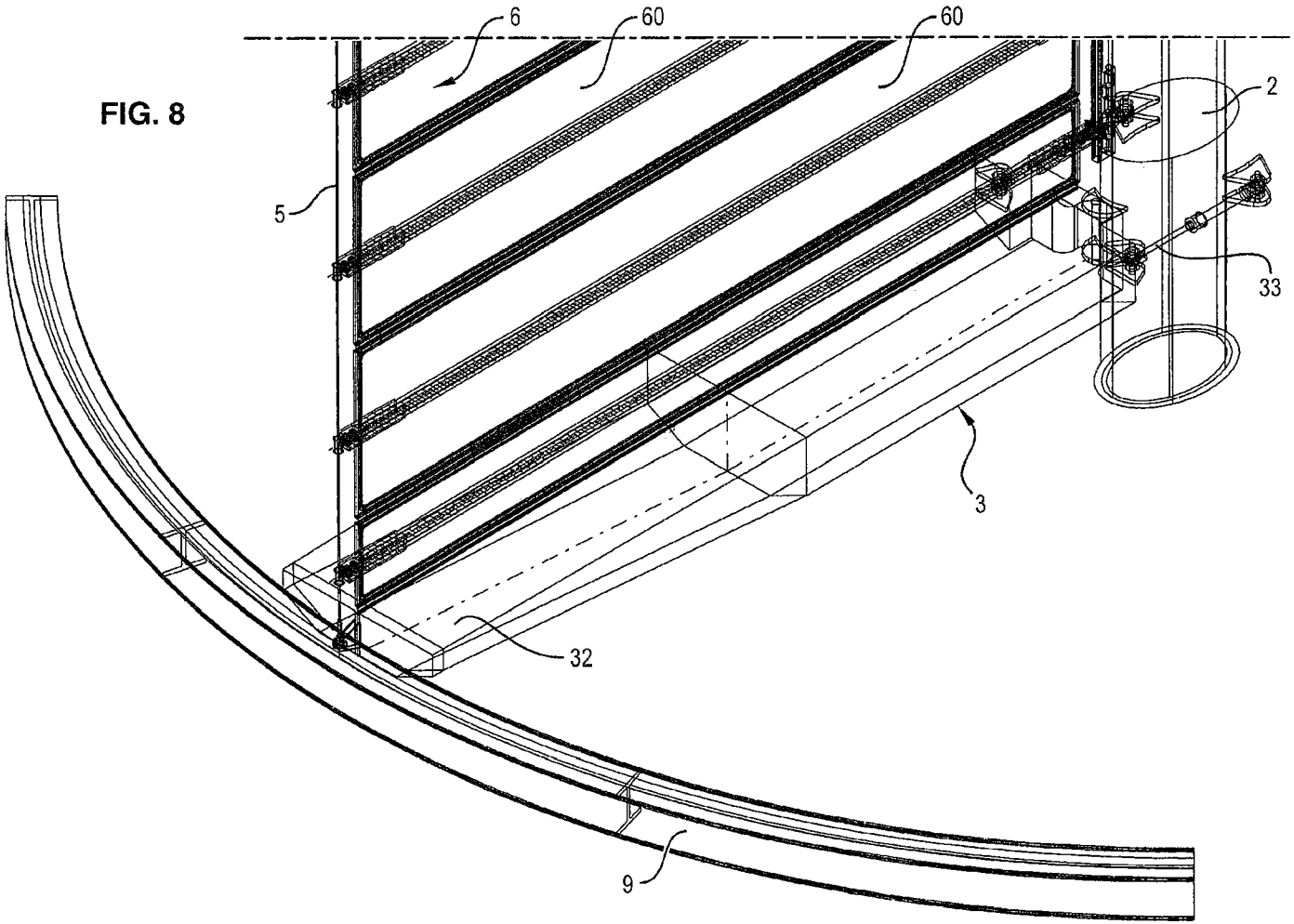

In these drawings:

FIG. 1 is a schematic side view of a mechanised device for manipulating a sail conforming to a first variant of embodiment of the invention, FIG. 2 is a schematic side view illustrating a second variant of embodiment of the invention, FIG. 3 is a side view illustrating two panels of the sail and its guiding systems, FIG. 4 schematically illustrates the sail in partly lowered position, FIGS. 5 and 6 give details of two variants of embodiment of the means for guiding the luff of the sail, FIG. 7 is a detail view of one embodiment of the means for guiding the leech of the sail, and FIG. 8 is a partial, perspective view of the lower part of the sail, of the boom and of the guide rail of the free end of the boom.

The mechanised device for manipulating a sail conforming to the invention carries the general reference 1. It will now be described in connection with FIGS. 1 and 2.

It is intended to be installed on the deck P of a ship, preferably a cargo vessel or passenger ship. In the latter case it will be installed on the ship's upper deck. Several of these devices can therefore be installed thereupon.

This device particularly comprises a mast 2, a boom 3, a gaff 4, a longitudinal guiding element 5 such as a cable, and a sail 6.

The mast 2 is erected vertically or substantially vertically on the deck P. It may be self-standing or held in position by any suitable securing means e.g. as is conventional by shrouds 20.

The boom 3 and the gaff 4 are spars which extend perpendicular or substantially perpendicular to the mast 2. They are secured to the mast 2 and mounted thereupon, preferably hinged fashion, via one of their so-called "fore" ends.

The "fore" ends of the boom 3 and of the gaff 4 respectively carry reference numbers 31 and 41. Their aft ends carry reference numbers 32, 42.

The terms "fore" and "aft" are chosen with reference to the front and rear of the ship.

The aft vertical guiding element 5 connects the aft end 32 of the boom 3 with the aft end 42 of the gaff 4, so that it extends parallel or substantially parallel to the mast 2. Preferably this guiding element 5 is a cable whose two ends are attached to the ends 32 and 42, and in the remainder of the description it will be described as such.

The tension of the cable 5 may optionally be adjusted by means of a hydraulic cylinder or any other tensioning means, not illustrated in the figures.

The sail 6 is of rectangular or substantially rectangular shape. It has a lower edge 61 called the "foot", a fore 62 and an aft 63 side edge respectively called the "luff" and the "leech", and an upper edge 64.

The sail 6 is attached to the boom via its foot 61.

The assembly formed of the mast 2, the boom 3, the gaff 4 and the cable 5 forms a frame inside which the sail 6 can be hoisted or lowered, whilst being laterally guided by its luff and leech, respectively along the mast 2 and the cable 5.

The luff 62 of the sail 2 is guided along the mast 2 by a suitable guiding system. One embodiment thereof can be seen in FIG. 3.

A longitudinal guide rail 21 is fixed along the mast, opposite the luff 62 of the sail 6. Also, the luff 62 is equipped with a plurality of travellers 620 capable of sliding along the said guide rail 21.

These travellers 620 are secured to the sail 6 and are distributed over the entire length of the luff 62, preferably at regular intervals, so as to guide the sail 6 over its entire height.

In the variant shown FIG. 3, the guide rail 21 is hinge-mounted relative to the mast 2, by means of hinges 22 so that it is able to pivot at an angle around a vertical axis Y-Y' parallel to the mast 2. This allows angle pivoting of the luff 62 which may be of advantage when the sail 6 pivots in relation to the direction of the wind.

According to one simplified variant of embodiment, not illustrated in the figures, the guide rail 21 is fixed.

Other means for guiding the luff 62 may also be envisaged, although these are not illustrated. For example, the guide rail 21 may be replaced by a groove formed longitudinally on the mast, the travellers 620 then being replaced by slides able to slide in the said groove.

Also, the leech 63 of the sail 6 is guided along the cable 5 by any suitable guiding means. As an example, and as illustrated FIG. 3, these guide means may be composed of several slides 630, capable of sliding along the guide cable 5. These slides 630 are secured to the sail 6 and are preferably distributed at regular intervals along the leech, so as to guide the sail 6 over its entire height.

These slides will be described in more detail below.

In one embodiment, not illustrated, the cable 5 could be replaced by a tube provided with a longitudinal slot, therefore forming a slideway and the slide is then in the form of a roller able to slide within the slideway.

The device conforming to the invention also comprises mechanised means for hoisting or lowering the sail 6.

According to the invention, these mechanised means are such that the tensioning of the luff 62 and of the leech 63 are performed in synchronized manner, so that at any time during the hoisting and lowering phases of the sail 6, the fore and aft halyard points are at the same height.

An example of embodiment of these mechanised means is described below.

With reference to FIG. 1 it can be seen that these comprise two lines called "halyards" one referenced 7 used to hoist the upper fore end of the sail 6 along the mast 2, and the other 8 used to hoist the upper aft end of the sail 6 along the cable 5.

In addition, the gaff 4 and the mast 2 are equipped on the outer or inner surface with several return pulleys which allow the halyards 7 and 8 to be brought onto the deck P level where each thereof is engaged on a winch that is preferably electric, not illustrated in the figures. The actuating of these two winches in winding or unwinding direction allows the sail 6 to be hoisted or conversely lowered.

The fore end 31 of the boom 3 is hinge-mounted at the base of the mast 2 by means of a hinge known as a "gooseneck" 33.

Adjustment of the sail 6 is carried out in particular by adjusting the position of the boom 3.

In the horizontal plane, the angular movements of the boom 3 allow the setting of the sail to be adjusted in relation to the wind. The orientation of the boom 3 in the horizontal plane is obtained for example by means of mainsheet tackle 34 well known to those skilled in the art, which will not be described in more detail. A multitude of systems can be designed to ensure this function, for example a hydraulic cylinder whose pipes feeding hydraulic fluid transit in the vicinity of the gooseneck.

According to another possibility illustrated FIG. 8, the aft end 32 of the boom 3 is provided with a traveller (not visible in the figure) capable of sliding in a rail 9 in the form of an arc of a circle.

In the vertical plane, the movements of the boom 3 allow the leech 63 to be tensioned or released and the belly of the sail 6 to be adjusted.

The movement of the boom 3 in a vertical plane is obtained for example using a downhaul 35 also well known to persons skilled in the art.

Similarly, the gaff 4 can be hinge-mounted on the mast 2 at its fore end 41 by means of a hinge system of "gooseneck" type. This makes movement possible in the horizontal plane and in a vertical plane.

Movement thereof in the horizontal plane is induced by the mainsheet tackle 34, the movement of the gaff 4 following the movement of the boom 3.

According to a first variant of embodiment illustrated FIG. 1, the gaff 4 is supported by a cable or halyard 43 run through the head of the mast. By means of return pulleys arranged in the mast 2, the end of this cable 43 can be sent to a winch not illustrated in the figures, fixed at deck level P for example. The greater or lesser winding of this cable 43 causes the gaff 4 to pivot in the vertical plane.

According to another variant of embodiment illustrated FIG. 2, the gaff 4 may also be supported by a structure of "wishbone" type 44 of which one end is secured to the mast 2 and the other to the gaff 4.

The gaff 4 may also be fixed relative to the mast 2 in a horizontal plane and in a vertical plane.

The device conforming to the invention may also be automated i.e. the functioning of the mechanised means for hoisting and lowering the sail, of the means for angular movement of the boom 3 and of the means for adjusting the angle position of the boom 3 and of the gaff 4 in a vertical plane, can be driven by a programmable logic controller or by computer as determined by parameters related to the force and/or direction of the wind for example.

The structure of the sail 6 will now be described in more detail.

This sail may be of large size, in particular when it is intended to be used on cargo vessels or passenger ships. In the latter case its surface may reach or even exceed 1000 $m^2$.

The sail 6 is preferably made in very thick sail fabric, but it may also be made in a relatively rigid composite material or even in metal.

Advantageously, the sail 6 can be formed of the assembly of several rectangular horizontal panels 60, preferably of identical dimensions and fabrication, the lower panel possibly and optionally being of smaller size.

As is better illustrated in FIG. 5, a panel 60 may comprise a rigid peripheral frame 601 and a more flexible central part 602, for example made in very thick sail fabric.

Depending on their structure and the type of material used for manufacturing the sail, the panels 60 may be more or less rigid. If they are rigid they are advantageously hinged relative to an adjacent panel 60 around a so-called "hinge" axis $X_1$-$X'_1$, parallel or substantially parallel to the longitudinal axis X-X' of the boom 3 (see in particular the views of details in FIGS. 3 and 5).

Advantageously, each panel 60 is connected to the adjacent panel 60 by a portion of flexible material 65.

According to other variants not illustrated in the figures, this portion 65 of flexible material could be replaced by straps or hinges. The purpose of these elements is to facilitate the hinging of two panels 60 relative to one another around an axis $X_1$-$X'_1$.

The hinging of the panels 60 of the sail relative to one another allows the automatic stacking of these panels when the sail is lowered. The sail 6 therefore folds with an accordion fold onto the boom 3, as schematically illustrated in FIG. 4.

As explained in the foregoing, the gaff 4 is fixed at the top part of the mast and it remains in this position even when the sail 6 is hoisted or lowered. The cable 5 also remains in its position parallel or substantially parallel to the mast 2, so that when the sail 6 is lowered it continues to be supported via its luff 62 along the mast 2 and via its leech 63 along the cable 5.

For this purpose, the sliders 630 and travellers 620 (guiding members) are adapted so as to allow rotation of each panel 60 around a longitudinal axis $X_2$-$X'_2$ passing via a traveller 620 and a slide 630. This axis of rotation $X_2$-$X'_2$ is parallel to the axes $X_1$-$X'_1$ and X-X'.

For this purpose, the sail 6 advantageously comprises rigidifying battens 66 fixed along the sail 6 as can be seen in FIG. 3, or extending towards the centre of the frame 601 as can be seen FIG. 5. These battens extend along the axis of rotation $X_2$-$X'_2$ such as previously defined.

The battens 66 allow reinforcing of the panel 60 by compression.

Advantageously, the members 620 and 630 for guiding the sail 6 in translation are respectively secured to each of the ends of the batten 66.

One first embodiment of the guiding traveller 620 will now be described with reference to FIG. 5.

The traveller 620 comprises a plate 621 equipped with rollers 622, here four in number, to allow guiding of the plate 621 by sliding along the rail 21. A rotating spindle 623 is fixed to the plate 621. It extends in the direction of the luff 62 of the sail along the axis $X_2$-$X'_2$ previously defined. This rotating spindle 623 is received in an anti-friction bearing 661 fixed inside the projecting end 660 of the batten 66.

This assembly allows rotation of the panel 60 around the axis $X_2$-$X'_2$.

A second embodiment of the guiding traveller will now be described with reference to FIG. 6. Identical elements carry the same reference numbers. This traveller is referenced 620'.

In this embodiment a pin 624 is fixed to the plate 621, it is equipped at its free end with a ball joint 625. This pin 624 extends in the direction of the luff 62 of the sail along the previously defined axis $X_2$-$X'_2$. The ball joint 625 is received in a multi-directional hinge bearing 662 fixed inside the projecting end 660 of the batten 66. In FIG. 6, and to facilitate understanding of the functioning thereof, this bearing 662 is illustrated in an exploded view (in two parts). These two parts are normally assembled.

This assembly not only allows rotation of the panel 60 around the axis $X_2$-$X'_2$ but also multi-directional angular pivoting around the axis $X_2$-$X'_2$ at an angle whose value is determined by the authorised clearance of the sail 6 in the horizontal plane compatible with the clearance given to the boom. It provides an additional degree of flexibility to the device.

An example of embodiment of the slide 630 will now be given with reference to FIG. 7.

The slide 630 comprises a sleeve 631 pierced with a longitudinal orifice 632 inside which the cable 5 is engaged. The sleeve 631 is able to slide along this cable 5. A rotating spindle 633 is fixed to the sleeve 631. It extends in the direction of the leech 63 of the sail 6 along the previously defined axis $X_2$-$X'_2$. This rotating spindle 633 is received in an anti-friction bearing 661' fixed inside the projecting end 660' of the batten 66.

This assembly allows rotation of the panel 60 around the axis $X_2$-$X'_2$.

It will be noted in the above descriptions of the traveller 620, 620' and of the slide 630, that the rotating spindles 623, 624 and 633 are respectively secured to the travellers 620, 620' and the slide 630 and that the antifriction bearings 661, 662 and 661' are secured to the batten. The reverse is also possible.

Finally, according to a variant not illustrated in the figures, the guide rail 21 provided on the mast 2 can also be replaced by a cable. In this case, the guiding traveller 620 is replaced by a slide 630.

The pivoting of the panels around the axes $X_2$-$X'_2$ combined with the flexible parts 65 (or equivalent) allows the sail 6 to be lowered in an accordion fold onto the boom 3. The boom is therefore designed to withstand the weight of the folded sail. Purely by way of illustration, this boom 3 may have a width of several meters e.g. four meters and a length of about twenty meters.

Once folded, the sail no longer offers any presents any resistance to the wind and there is no risk of undue unfolding.

Advantageously the height of the travellers and slides is equal to the thickness of a panel so that when the sail is folded on the boom, the stacked panels remain flat and horizontal.

If the sail 6 is made in a material of rigid composite type or metal, it can be slightly shaped so that once deployed the sail has a camber that is aerodynamically optimised to provide maximum lift. In this latter case, some panels 60 panels may have a shape that differs slightly from the others.

Finally, preferably each panel 60 is designed so that it can be separated from other adjacent panels, so that it can be replaced in the event of wear or damage. Replacement panels 60 could therefore be stored on board the ship so that it is possible to replace a faulty panel during navigation.

This separation can be performed for example by making provision for additional securing means of male/female type between the edge of a panel 60 and the portion of flexible material 65 e.g. a rib and a groove inside which the rib can be inserted by sliding.

The invention claimed is:

1. A mechanised device for manipulating a ship's sail comprising:

a mast, a boom and a gaff each having first fore ends and second opposite aft ends, said boom and gaffe each respectively secured to said mast via said fore ends, a guiding element connecting said aft ends of said boom and of said gaff, so that said guiding element extends parallel or substantially parallel to said mast and defines a frame jointly with said mast, boom and gaff, a sail of rectangular or substantially rectangular shape having a lower foot edge and a first luff side edge and a second leech side edge, said sail secured to said boom via said lower foot edge and provided on said luff and leech side edges with guiding members along said mast and said guiding element, and mechanised means of hoisting and lowering said sail inside said frame, whilst guiding said sail luff and leech side edges along said mast and guiding element, wherein said guiding members allow rotation of said sail around a longitudinal axis $X_2$-$X'_2$ joining together a guiding member along said mast and a guiding member along said guiding element, said longitudinal axis being parallel or substantially parallel to said boom so that said sail, when lowered, is folded in an accordion fold on said boom, wherein the guiding member of said sail leech side edge is a slide, said slide comprising a sleeve sliding along the guiding element and wherein said sleeve or said sail leech side edge is provided with a rotating spindle, said rotating spindle extending over the axis of rotation $X_2$-$X'_2$ and received in an antifriction bearing secured respectively to said sail leech side edge or said sleeve.

2. The device according to claim 1, wherein the guiding element is a cable.

3. The device according to claim 1, wherein the sail is composed of several panels, each panel provided along a luff side edge with a guiding member along the mast and along a leech side edge with a guiding member along said guiding element.

4. The device according to claim 1, wherein the mast comprises a longitudinal guide rail, and the guiding member of said sail luff side edge comprises a traveller sliding along said guide rail, said traveller being provided with a rotating spindle, said rotating spindle extends over the axis of rotation $X_2$-$X'_2$ and is received in an antifriction bearing secured to said sail luff side edge.

5. The device according to claim 1, wherein the mast comprises a longitudinal guide rail, and the guiding member of said sail luff side edge comprises a traveller sliding along said guide rail, said traveller being provided with a pin, said pin extends over the axis of rotation $X_2$-$X'_2$ and includes an end with a ball joint received in a multi-directional hinge bearing secured to said sail luff side edge.

6. The device according to claim 1, wherein the sail comprises several panels, each panel being hinged on the adjacent panel around a hinge axis $X_1$-$X'_1$, parallel or substantially parallel to the boom.

7. The device according to claim 6, wherein each panel is hinged on the adjacent panel via a portion of flexible material, a hinge or a strap.

8. The device according to claim 3, wherein at least one of the panels is provided with a longitudinal batten which extends over the axis of rotation $X_2$-$X'_2$ of said panel.

9. The device according to claim 3, wherein each panel is removably attached to the others so that it can be separated from the others, dismounted and replaced.

10. The device according to claim 1, wherein the sail includes fore and aft halyard points and the mechanised means of hoisting and lowering the sail comprise means for tensioning the luff and the leech of the sail in synchronized manner, so that at any time during the phases of hoisting and lowering the sail, the fore and aft halyard points of the said sail are at the same height.

11. The device according to claim 1, wherein the sail is made of fabric, of composite material or of metal.

12. A cargo or passenger ship equipped with a mechanised device for manipulating a sail according to claim 1.

13. The device according to claim 1, wherein the sail comprises rigidifying battens extending along said longitudinal axis $X_2$-$X'_2$.

* * * * *